US005282005A

United States Patent [19]

Nowak et al.

[11] Patent Number: 5,282,005

[45] Date of Patent: Jan. 25, 1994

[54] CROSS PROCESS VIBRATIONAL MODE SUPPRESSION IN HIGH FREQUENCY VIBRATORY ENERGY PRODUCING DEVICES FOR ELECTROPHOTOGRAPHIC IMAGING

[75] Inventors: William J. Nowak, Webster; David B. Montfort, Pennfield; Ronald E. Stokes, Fairport, all of N.Y.

[73] Assignee: Xerox Corporation, Stamford, Conn.

[21] Appl. No.: 3,906

[22] Filed: Jan. 13, 1993

[51] Int. Cl.[5] ..... G03G 15/16

[52] U.S. Cl. ..... 355/273; 355/271; 355/296; 310/326

[58] Field of Search ..... 355/271, 273, 296; 118/652; 134/1; 310/325-326, 328; 15/1.51; 430/126

[56] References Cited

U.S. PATENT DOCUMENTS

| | | | |
|---|---|---|---|
| 3,113,225 | 12/1963 | Kleesattel et al. | 310/26 |
| 3,190,793 | 6/1965 | Starke | 162/278 |
| 3,422,479 | 1/1969 | Jeffee | 15/100 |
| 3,483,034 | 12/1969 | Ensminger | 134/1 |
| 3,635,762 | 1/1972 | Ott et al. | 134/1 |
| 3,653,758 | 4/1972 | Trimmer et al. | 355/273 |
| 3,713,987 | 1/1973 | Low | 195/127 |
| 3,733,238 | 5/1973 | Long et al. | 156/580 |
| 3,854,974 | 12/1974 | Sato et al. | 117/17 |
| 4,007,982 | 2/1977 | Stange | 355/299 |
| 4,111,546 | 9/1978 | Maret | 355/297 |
| 4,121,947 | 10/1978 | Hemphill | 134/1 |
| 4,363,992 | 12/1982 | Holze, Jr. | 310/323 |
| 4,546,722 | 10/1985 | Toda et al. | 118/657 |
| 4,568,955 | 2/1986 | Hosoya et al. | 346/153.1 |
| 4,651,043 | 3/1987 | Harris et al. | 310/323 |
| 4,684,242 | 8/1987 | Schultz | 355/307 |
| 4,794,878 | 1/1989 | Connors et al. | 118/653 |
| 4,833,503 | 5/1989 | Snelling | 355/259 |
| 4,987,456 | 1/1991 | Snelling et al. | 355/273 |
| 5,005,054 | 4/1991 | Stokes et al. | 355/273 |
| 5,010,369 | 4/1991 | Nowak et al. | 355/273 |
| 5,016,055 | 5/1991 | Pietrowski et al. | 355/273 |
| 5,025,291 | 6/1991 | Nowak et al. | 355/273 |
| 5,030,999 | 7/1991 | Lindblad et al. | 355/297 |
| 5,045,746 | 9/1991 | Wersing et al. | 310/326 X |
| 5,081,500 | 1/1992 | Snelling | 355/273 |
| 5,210,577 | 5/1993 | Nowak | 355/273 |

FOREIGN PATENT DOCUMENTS

| | | |
|---|---|---|
| 2280115 | of 1976 | France . |
| 62-195685 | 8/1987 | Japan . |

OTHER PUBLICATIONS

Xerox Disclosure Journal, "Floating Diaphragm Vacuum Shoe", Hull et al., vol. 2, No. 6, Nov./Dec. 1977; pp. 117-118.

Defensive Publications, T893,001, Dec. 14, 1971; Fisler.

*Primary Examiner*—Matthew S. Smith

*Attorney, Agent, or Firm*—Mark Costello

[57] ABSTRACT

An electrophotographic device having an imaging member with a charge retentive surface, driven along an endless path through a series of processing stations that create a latent image on the charge retentive surface, develop the image with toner, and bring a sheet of paper or other transfer member into intimate contact with the charge retentive surface at a transfer station for electrostatic transfer of toner from the charge retentive surface to the sheet. For the enhancement of toner release from a surface at any of the processing stations, a resonator suitable for generating vibratory energy is arranged in line contact with the back side of the non-rigid member, to uniformly apply vibratory energy thereto. The resonator includes a vibrational energy producing device; a horn member for transmitting vibrational energy, divided into a plurality of horn elements, each horn element including a horn portion and a contacting portion in substantially non-contacting relationship with a horn portion and a contacting portion or any adjacent horn elements, each horn vibrating when driven by the vibratory energy producing piezoelectric device, in an axial mode toner releasing vibration, and a transverse mode causing non-uniform response among the horn elements; and an energy dissipating media inserted into the inter element gaps for substantially damping the transverse mode vibration, while substantially allowing the axial mode vibration.

15 Claims, 10 Drawing Sheets

CROSS PROCESS VIBRATIONAL MODE SUPPRESSION IN HIGH FREQUENCY VIBRATORY ENERGY PRODUCING DEVICES FOR ELECTROPHOTOGRAPHIC IMAGING

This invention relates to reproduction apparatus, and more particularly, to an apparatus for uniformly applying high frequency vibratory energy to an imaging surface for electrophotographic applications.

INCORPORATION BY REFERENCE

The following United States patents are specifically incorporated by reference for their background teachings, and specific teachings of the principles of operation, construction and use of resonators for applying toner releasing vibrations to the charge retentive surfaces of electrophotographic devices: U.S. Pat. No. 5,030,999 to lindblad et al.; U.S. Pat. No. 5,005,054 to Stokes et al.; U.S. Pat. No. 4,987,456 to Snelling et al.; U.S. Pat. No. 5,010,369 to Nowak et al.; U.S. Pat. No. 5,025,291 to Nowak et al.; U.S. Pat. No. 5,016,055 to Pietrowski et al.; U.S. Pat. No. 5,081,500 to Snelling; U.S. Pat. No. 5,210,577 to Nowak and U.S. patent application Ser. No. 07/620,520, "Energy Transmitting Horn Bonded to an Ultrasonic Transducer for improved Uniformity at the Horn Tip", by R. Stokes.

BACKGROUND OF THE INVENTION

In electrophotographic applications such as xerography, a charge retentive surface is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder or powder suspension referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known and useful for light lens copying from an original and printing applications from electronically generated or stored originals, where a charged surface may be imagewise discharged in a variety of ways. Ion projection devices where a charge is imagewise deposited on a charge retentive substrate operate similarly. In a slightly different arrangement, toner may be transferred to an intermediate surface, prior to retransfer to a final substrate.

Transfer of toner from the charge retentive surface to the final substrate is commonly accomplished electrostatically. A developed toner image is held on the charge retentive surface with electrostatic and mechanical forces. A substrate (such as a copy sheet) is brought into intimate contact with the surface, sandwiching the toner thereinbetween. An electrostatic transfer charging device, such as a corotron, applies a charge to the back side of the sheet, to attract the toner image to the sheet.

Unfortunately, the interface between the sheet and the charge retentive surface is not always optimal. Particularly with non-flat sheets, such as sheets that have already passed through a fixing operation such as heat and/or pressure fusing, or perforated sheets, or sheets that are brought into imperfect contact with the charge retentive surface, the contact between the sheet and the charge retentive surface may be non-uniform, characterized by gaps where contact has failed. There is a tendency for toner not to transfer across these gaps. A copy quality defect referred to as transfer deletion results.

The problem of transfer deletion has been unsatisfactorily addressed by mechanical devices that force the sheet into the required intimate and complete contact with the charge retentive surface. Blade arrangements that sweep over the back side of the sheet have been proposed, but tend to collect toner if the blade is not cammed away from the charge retentive surface during the interdocument period, or frequently cleaned. Biased roll transfer devices have been proposed, where the electrostatic transfer charging device is a biased roll member that maintains contact with the sheet and charge retentive surface. Again, however, the roll must be cleaned. Both arrangements can add cost, and mechanical complexity.

That acoustic agitation or vibration of a surface can enhance toner release therefrom is known, as described by U.S. Pat. No. 4,111,546 to Maret, U.S. Pat. No. 4,684,242 to Schultz, U.S. Pat. No. 4,007,982 to Stange, U.S. Pat. No. 4,121,947 to Hemphill, Xerox Disclosure Journal "Floating Diaphragm Vacuum Shoe, by Hull et al., Vol. 2, No. 6, November/December 1977, U.S. Pat. No. 3,653,758 to Trimmer et al., U.S. Pat. No. 4,546,722 to Toda et al., U.S. Pat. No. 4,794,878 to Connors et al., U.S. Pat. No. 4,833,503 to Snelling, Japanese Published Patent Application 62-195685, U.S. Pat. No. 3,854,974 to Sato et al., and French Patent No. 2,280,115.

Resonators for applying vibrational energy to some other member are known, for example in U.S. Pat. No. 4,363,992 to Holze, Jr. which shows a horn for a resonator, coupled with a piezoelectric transducer device supplying vibrational energy, and provided with slots partially through the horn for improving non uniform response along the tip of the horn. U.S. Pat. No. 3,113,225 to Kleesattel et al. describes an arrangement wherein an ultrasonic resonator is used for a variety of purposes, including aiding in coating paper, glossing or compacting paper and as friction free guides. U.S. Pat. No. 3,733,238 to Long el al. shows an ultrasonic welding device with a stepped horn. U.S. Pat. No. 3,713,987 to Low shows ultrasonic agitation of a surface, and subsequent vacuum removal of released matter.

Coupling of vibrational energy to a surface has been considered in Defensive Publication T893,001 by Fisler. U.S. Pat. No. 3,635,762 to Ott et al., U.S. Pat. No. 3,422,479 to Jeffee, U.S. Pat. No. 4,483,034 to Ensminger and U.S. Pat. No. 3,190,793 Starke.

In the ultrasonic welding horn art, as exemplified by U.S. Pat. No. 4,363,992 to Holze, Jr., where blade-type welding horns are used for applying high frequency energy to surfaces, it is known that the provision of slots through the horn perpendicular to the direction in which the welding horn extends, reduces undesirable mechanical coupling of effects across the contacting horn surface. Accordingly, in such art, the contacting portion of the horn is maintained as a continuous surface, the horn portion is segmented into a plurality of segments, and the horn platform, support and piezoelectric driver elements are maintained as continuous members. For uniformity purposes, it is desirable to segment the horn so that each segments acts individually. However, a unitary construction is also highly desirable, for fabrication and mounting purposes.

It has been noted that even with fully segmented horns, as shown in U.S. Pat. No. 5,025,291 to Nowak et al., there is a fall-off in response of the resonator at the outer edges of the device and generally, some segment to segment non-uniformity. A similar fall off is shown in U.S. Pat. No. 4,363,992 to Holze, Jr., at FIG. 2, showing the response of the resonator of FIG. 1.

Of interest is U.S. Pat. No. 4,833,503 to Snelling, which describes ultrasonic transducer-driven toner transport in a development system, in which a current source provides a wave pattern to move toner from a sump to a photoreceptor. U.S. Pat. No. 4,568,955 to Hosoya et al. teaches recording apparatus with a developing roller carrying developer to a recording electrode, and a signal source for propelling the developer from the developing roller to the recording media.

The key to uniform vibration amplitudes across an ultrasonic resonator of the type used to enhance and enable electrophotographic processes is the decoupling of desired axial resonator motion (motion perpendicular to the charge retentive surface that caused toner release towards the final substrate) from undesirable transverse motion (motion in the cross process direction, parallel to the charge retentive surface). Even when resonator design parameters are optimized, transverse segmentation and discrete voltage modifications (as in U.S. Pat. No. 5,010,369 to Nowak et al. and U.S. Pat. No. 5,025,291 to Nowak et al. and U.S. patent application Ser. No. 07/887,037 entitled, "Edge Effect Compensation in High Frequency Vibratory Energy Producing Devices for Electrophotographic Imaging" by W. Nowak) will not completely eliminate this cross process direction non-uniformity. The root problem of non-uniformity is shown in FIG. 1A-1C, which shows, at FIG. 1A, a segmented transducer design (with segmented horn). At FIG. 1B, the frequency response amplitude over a 5 KHz range of individual horn segments along the length of a resonator is shown, illustrating the respective responses in the axial direction (labeled) and the transverse direction (labeled). At FIG. 1C, a plot of peak response amplitude of individual segments at 64 KHz in a resonator having 32 segments is shown, with non-uniformity resulting from bending and axial mode cross coupling at the arrow-marked areas.

Because mechanical continuum behavior in one dimension effects behavior in other dimensions, physical decoupling of what is referred to as the "Poisson effect" is required, by segmenting the transducer, as shown in FIG. 1A, and described in U.S. Pat. No. 5,025,291 to Nowak et al. This minimizes, but alone cannot eliminate, the effect of the undesirable transverse modes along the length of the resonator, and maximizes axial transducer motion. Theoretically, a structure completely eliminating the transverse mode would provide discrete resonator segments. Such a structure is not practical, since the vibratory energy of the resonator must somehow be coupled across the entire process width of the charge retentive surface. Additionally, it is highly desirable to have a unitary assembly for manufacturing and service reasons. It is speculated by the present inventors that such discrete resonators could be coupled with a compliant bond between individual segments, or with a compliant segment holder, but horn tip alignment and structural instability would be a major concern, with horn tip motion during operation on the order of 1 micron. Thus, complete segmentation is not practical.

All the references cited herein are specifically incorporated by reference for their teachings.

SUMMARY OF THE INVENTION

In accordance with the invention there is provided a resonator for uniformly applying vibratory energy to a non-rigid image bearing member of an electrophotographic device to cause mechanical release of a toner from the charge retentive surface for subsequent enhanced electrostatic transfer, where the resonator includes a plurality of individually responsive elements in a unitary structure, with transverse mode damping between elements.

In accordance with one aspect of the invention, an electrophotographic device of the type contemplated by the present invention includes a non-rigid member having a charge retentive surface, driven along an endless path through a series of processing stations that create a latent image on the charge retentive surface, develop the image with toner, and bring a sheet of paper or other transfer member into intimate contact with the charge retentive surface at a transfer station for electrostatic transfer of toner from the charge retentive surface to the sheet. Subsequent to transfer, the charge retentive surface is cleaned of residual toner and debris. For the enhancement of toner release from a surface at any of the processing stations, a resonator suitable for producing vibratory energy is arranged in line contact with the back side of the non-rigid member to uniformly apply vibratory energy thereto. The resonator comprises a horn, a continuous support member, and a vibration producing member that drives the horn at a resonant frequency to apply vibratory energy to the belt. The horn includes a platform or base portion, a horn portion extending therefrom, and having a contacting tip. The horn is segmented, through the contacting tip to the platform portion, into a plurality of elements which each act more or less individually. In the inter-element gap, an energy absorbing media is inserted to dampen transverse mode vibration.

In a slightly different embodiment, the horn may be noncompletely segmented, where the horn is segmented from the contacting tip to the platform portion, but leaving a continuous tip surface for engagement with the non-rigid member. In the inter-element gap, an energy absorbing media is inserted to dampen transverse mode vibration.

In accordance with another aspect of the invention, rather than inserting an energy absorbing media in the inter-element gap, an energy absorbent media is adhered to the upstream and downstream side surfaces of the horn, spanning a series of gaps, to dampen transverse mode vibration.

The present invention proposes that the undesirable cross process direction components of vibration can be attenuated by introducing energy absorbing media to the side edges of the horn, bridging the horn element gaps, and/or in the inter-element gaps. When the resonator vibrates in the axial direction, the horn elements will tend to move in phase with one another. Without relative motion between horn elements, energy dissipated into the energy absorbing media will be a minimum. However, when the resonator vibrates in the transverse direction, the horn segments will move out of phase with one another. With relative motion between horn elements, energy dissipation into the energy absorbing material will be at a maximum.

U.S. patent application Ser. No. 07/368,044, entitled "High Frequency Vibratory Enhanced Cleaning in an Electrostatic Imaging Device", assigned to the same assignee as the present invention, and specifically incorporated herein by reference, suggests preclean treatment enhancement by application of vibratory energy. The present invention finds use in this application as well.

These and other aspects of the invention will become apparent from the following description used to illustrate a preferred embodiment of the invention read in conjunction with the accompanying drawings in which:

FIGS. 1A, 1B and 1C, respectively show a segmented transducer design, the frequency response in axial and transverse modes and the peak response amplitude of individual segments;

Figure 6:
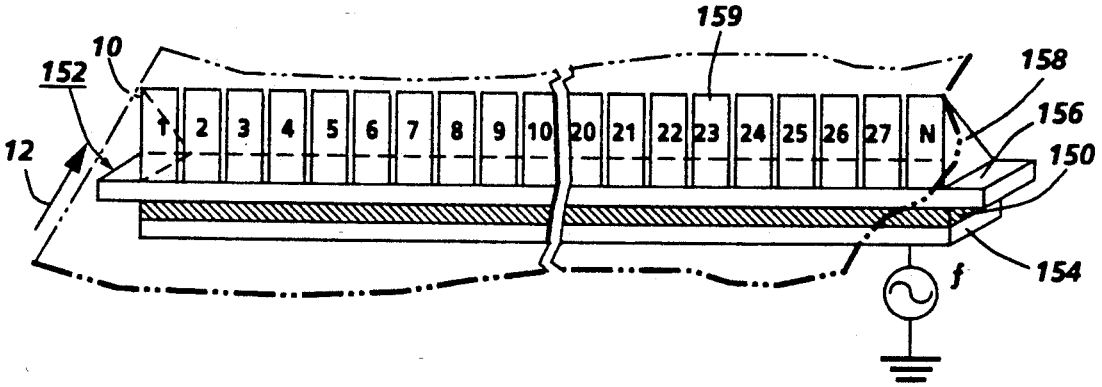
FIG. 6 shows a view of a resonator without the present invention.
Figure 7A:
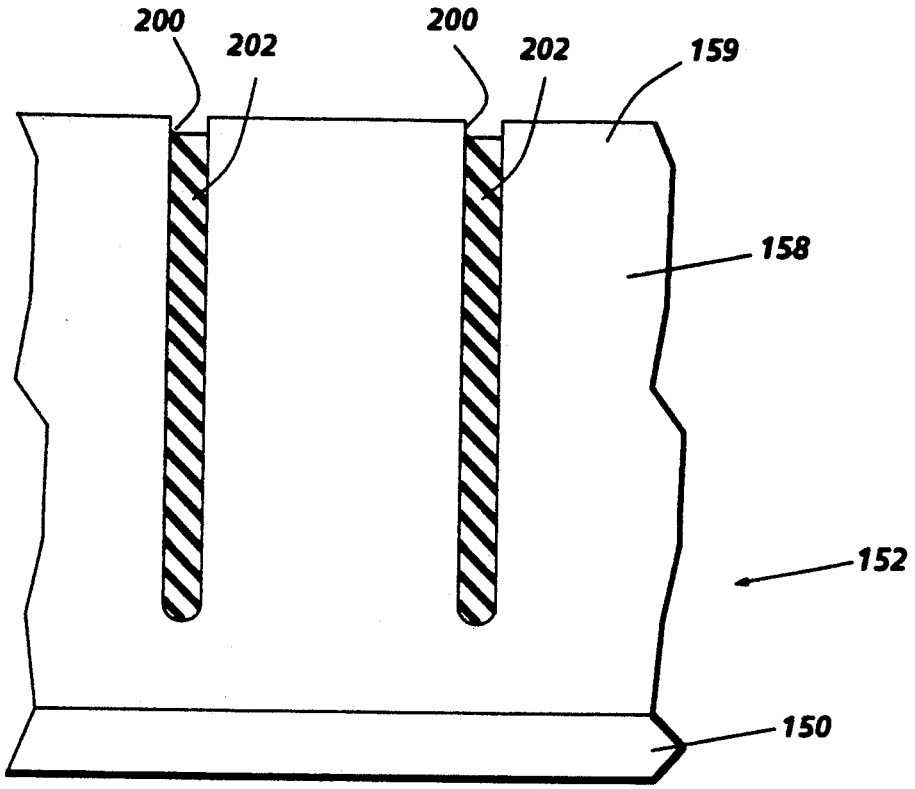
Figure 7B:
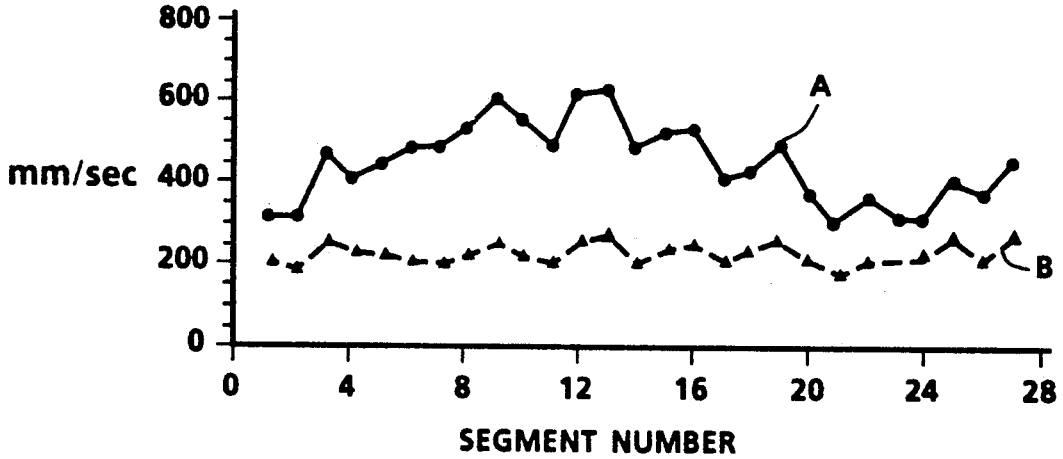
Figure 8A:
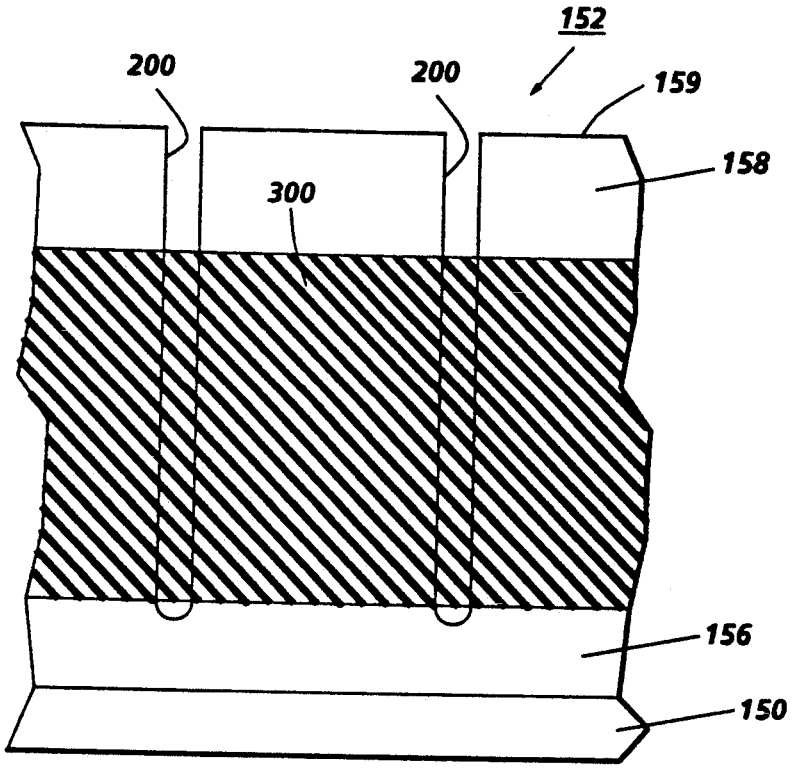
Figure 8B:
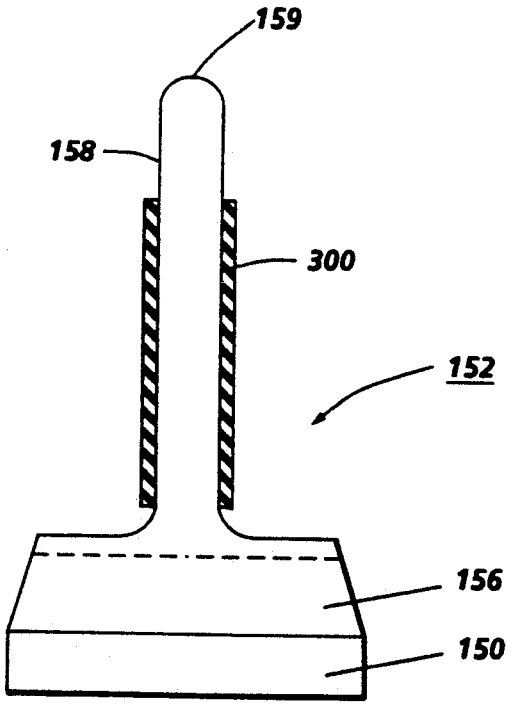
Figure 8C:
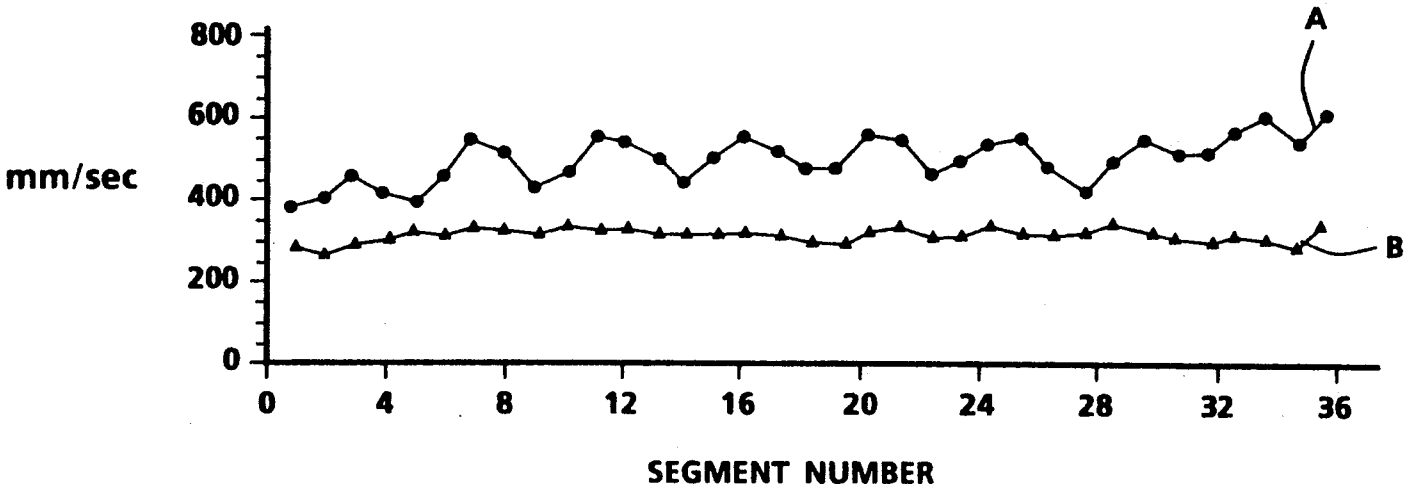

FIGS. 7A and 7B are, respectively, a sectional view of the resonator of FIG. 6, incorporating the invention and a graph comparing resonator response with and without the invention across the tip at a selected frequency; and FIGS. 8A, 8B and 8C are, respectively, a sectional view of the resonator of FIG. 6 incorporating an alternative embodiment of the invention; a cross sectional view of the resonator of FIG. 7A incorporating an alternative embodiment of the invention; and a graph comparing resonator response with and without the invention across the tip at a selected frequency.

Figure 2:
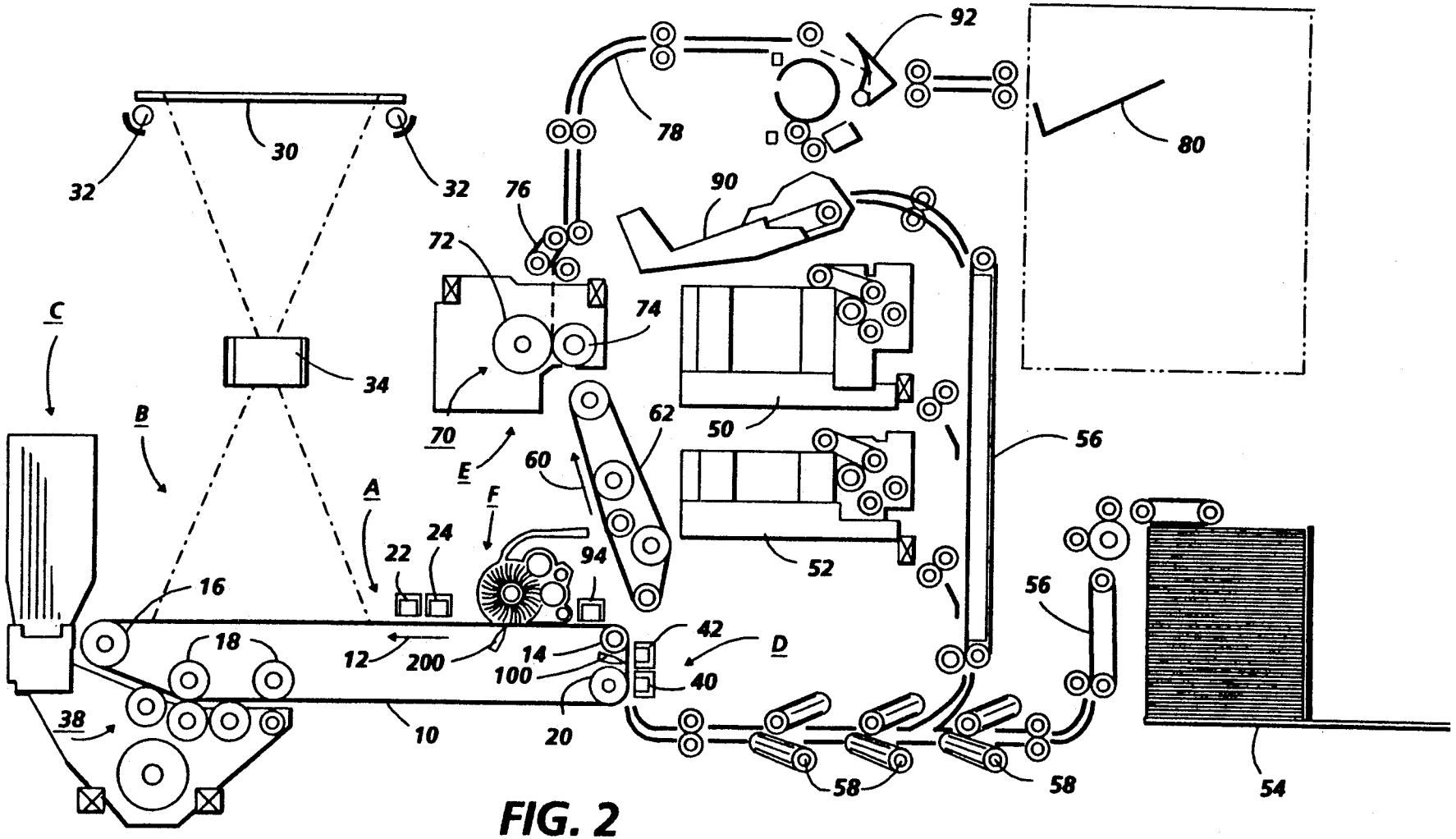
FIG. 2 is a schematic elevational view depicting an electrophotographic printing machine incorporating the present invention.

Referring now to the drawings, where the showings are for the purpose of describing a preferred embodiment of the invention and not for limiting same, the various processing stations employed in the reproduction machine illustrated in FIG. 2 will be described only briefly. It will no doubt be appreciated that the various processing elements also find advantageous use in electrophotographic printing applications from an electronically stored original.

A reproduction machine in which the present invention finds advantageous use utilizes a photoreceptor belt 10. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive.

Belt 10 is maintained in tension by a pair of springs (not shown) resiliently urging tension roller 16 against belt 10 with the desired spring force. Both stripping roller 18 and tension roller 16 are rotatably mounted. These rollers are idlers which rotate freely as belt 10 moves in the direction of arrow 12.

Figure 1A:
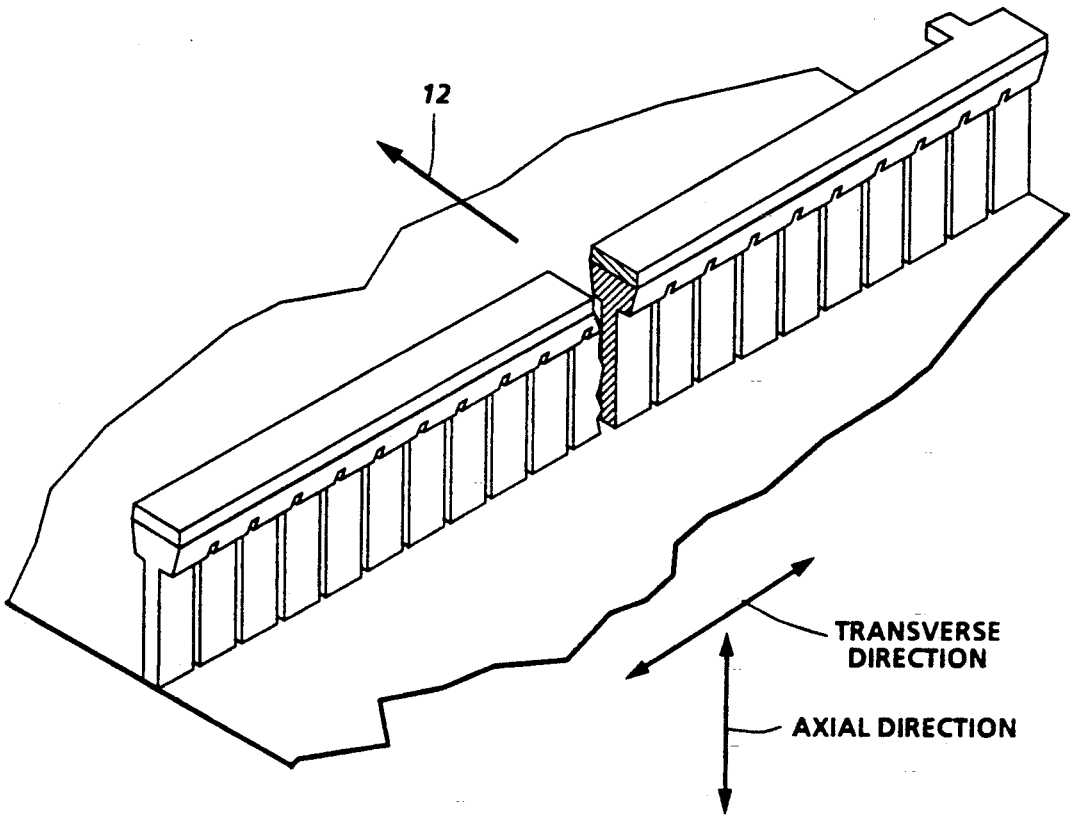
Figure 1B:
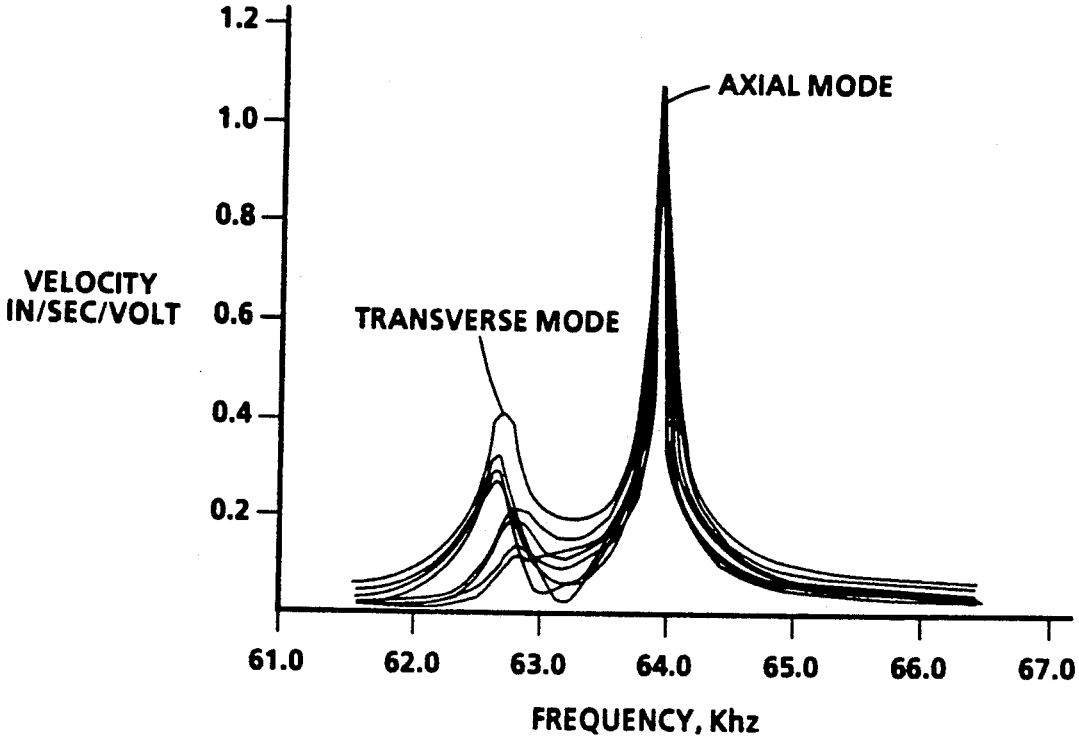
Figure 1C:
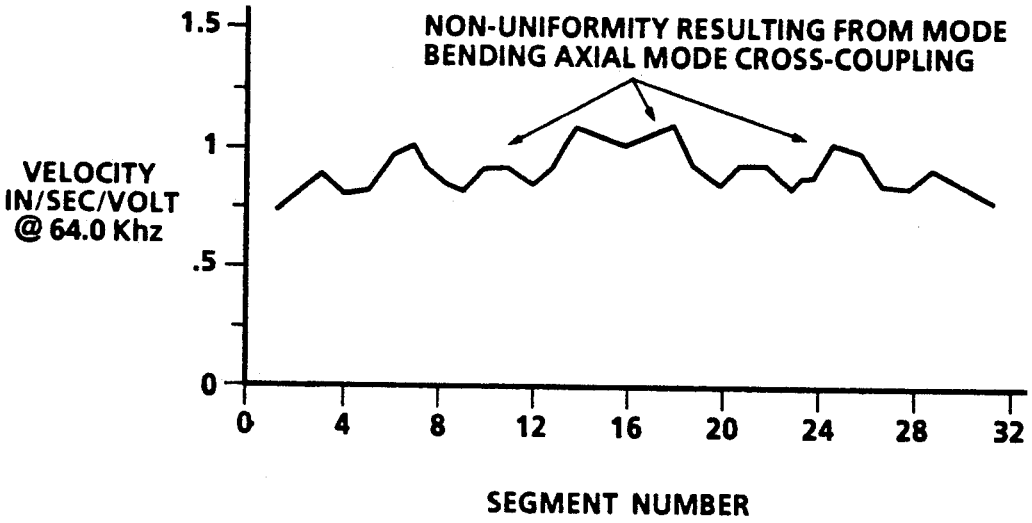

With continued reference to FIG. 1, initially a portion of belt 10 passes through charging station A. At charging station A, a pair of corona devices 22 and 24 charge photoreceptor belt 10 to a relatively high, substantially uniform negative potential.

At exposure station B, an original document is positioned face down on a transparent platen 30 for illumination with flash lamps 32. Light rays reflected from the original document are reflected through a lens 34 and projected onto a charged portion of photoreceptor belt 10 to selectively dissipate the charge thereon. This records an electrostatic latent image on the belt which corresponds to the informational area contained within the original document.

Thereafter, belt 10 advances the electrostatic latent image to development station C. At development station C, a developer unit 38 advances one or more colors or types of developer mix (i.e. toner and carrier granules) into contact with the electrostatic latent image. The latent image attracts the toner particles from the carrier granules thereby forming toner images on photoreceptor belt 10. As used herein, toner refers to finely divided dry ink, and toner suspensions in liquid.

Belt 10 then advances the developed latent image to transfer station D. At transfer station D, a sheet of support material such as a paper copy sheet is moved into contact with the developed latent image on belt 10. First, the latent image on belt 10 is exposed to a pretransfer light from a lamp (not shown) to reduce the attraction between photoreceptor belt 1 0 and the toner image thereon. Next, corona generating device 40 charges the copy sheet to the proper potential so that it is tacked to photoreceptor belt 10 and the toner image is attracted from photoreceptor belt 10 to the sheet. After transfer, a corona generator 42 charges the copy sheet with an opposite polarity to detack the copy sheet for belt 1 0, whereupon the sheet is stripped from belt 10 at stripping roller 14. The support material may also be an intermediate surface or member, which carries the toner image to a subsequent transfer station for transfer to a final substrate. These types of surfaces are also charge retentive in nature. Further, while belt type members are described herein, it will be recognized that other substantially non-rigid or compliant members may also be used with the invention.

Sheets of support material are advanced to transfer station D from supply trays 50, 52 and 54, which may hold different quantities, sizes and types of support materials. Sheets are advanced to transfer station D along conveyor 56 and rollers 58. After transfer, the sheet continues to move in the direction of arrow 60 onto a conveyor 62 which advances the sheet to fusing station E.

Fusing station E includes a fuser assembly, indicated generally by the reference numeral 70, which permanently affixes the transferred toner images to the sheets. Preferably, fuser assembly 70 includes a heated fuser roller 72 adapted to be pressure engaged with a back-up roller 74 with the toner images contacting fuser roller 72. In this manner, the toner image is permanently affixed to the sheet.

After fusing, copy sheets bearing fused images are directed through decurler 76. Chute 78 guides the advancing sheet from decurler 76 to catch tray 80 or a finishing station for binding, stapling, collating etc., and removal from the machine by the operator. Alternatively, the sheet may be advanced to a duplextray 90 from duplex gate 92 from which it will be returned to the processor and conveyor 56 for receiving second side copy.

A preclean corona generating device 94 is provided for exposing residual toner and contaminants (hereinafter, collectively referred to as toner) to corona to thereby narrow the charge distribution thereon for more effective removal at cleaning station F. It is contemplated that residual toner remaining on photoreceptor belt 10 after transfer will be reclaimed and returned to the developer station C by any of several well known reclaim arrangements, and in accordance with the arrangement described below, although selection of a non-reclaim option is possible.

As thus described, a reproduction machine in accordance with the present invention may be any of several well known devices. Variations may be expected in specific processing, paper handling and control arrangements without affecting the present invention.

Figure 3:
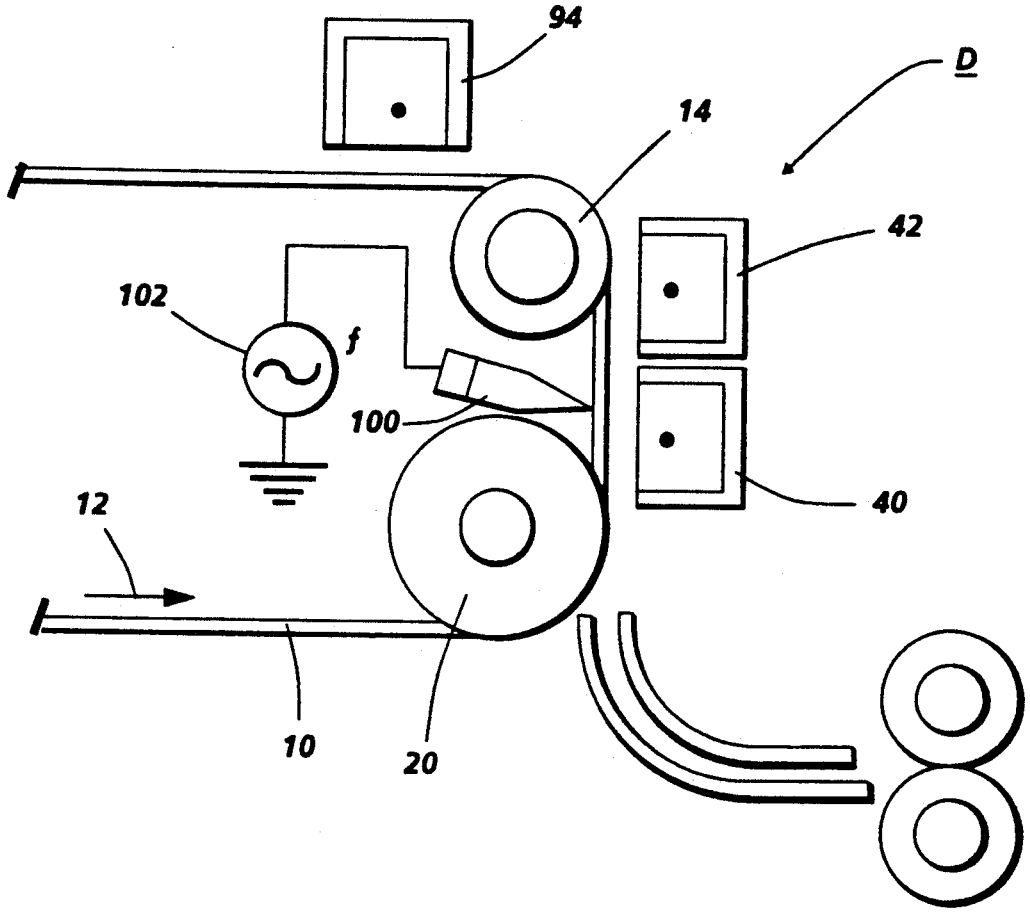
FIG. 3 is a schematic illustration of the transfer station and the associated ultrasonic transfer enhancement device of the invention.

With reference to FIG. 3, the basic principle of enhanced toner release is illustrated, where a relatively high frequency acoustic or ultrasonic resonator 100 driven by an A.C. source 102 operated at a frequency f between 20 kHz and 200 kHz, is arranged in vibrating relationship with the interior or back side of belt 10, at a position closely adjacent to where the belt passes through transfer station D. Vibration of belt 10 agitates toner developed in imagewise configuration onto belt 10 for mechanical release thereof from belt 10, allowing the toner to be electrostatically attracted to a sheet during the transfer step, despite gaps caused by imperfect paper contact with belt 10. Additionally, increased transfer efficiency with lower transfer fields than normally used appears possible with the arrangement. Lower transfer fields are desirable because the occurrence of air breakdown (another cause of image quality defects) is reduced. Increased toner transfer efficiency is also expected in areas where contact between the sheet and belt 10 Is optimal, resulting in improved toner use efficiency, and a lower load on the cleaning system F. In a preferred arrangement, the resonator 100 is arranged with a vibrating surface parallel to belt 10 and transverse to the direction of belt movement 12, generally with a length approximately coextensive with the belt width. The belt described herein has the characteristic of being non-rigid, or somewhat flexible, to the extent that it can be made to follow the resonator vibrating motion.

Figure 4:
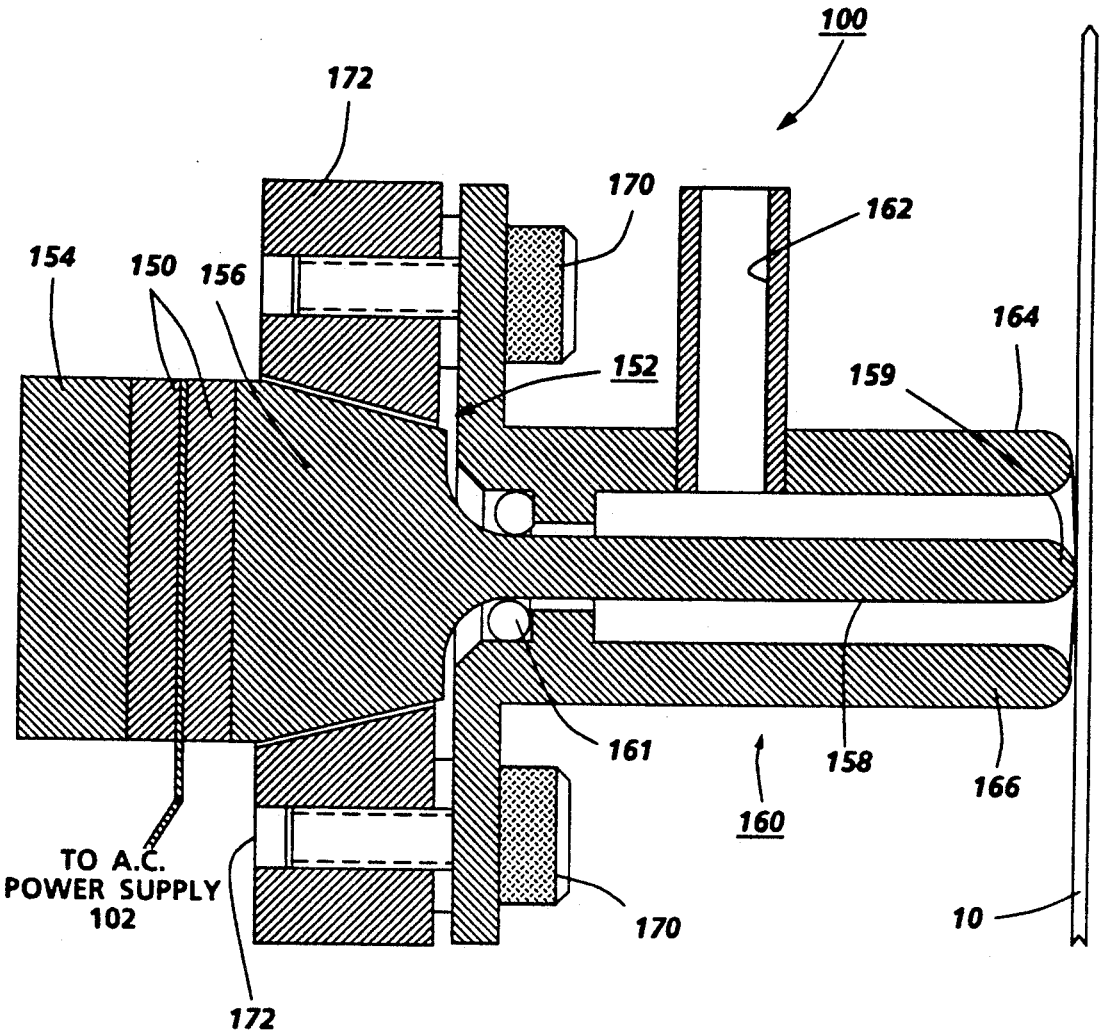
FIG. 4 illustrates schematically an arrangement to couple an ultrasonic resonator to an imaging surface.

With reference to FIG. 4, vibratory energy of the resonator 100 may be coupled to belt 10 in a number of ways, better shown, for example in U.S. Pat. No. 5,010,369 to Nowak et al. In the arrangements shown, resonator 100 may comprise a piezoelectric transducer element 150 and horn 152, together supported on a backplate 154. Horn 152 includes a platform portion 156 and a horn tip 158 and a contacting tip 159 in contact with belt 10 to impart the ultrasonic acoustic energy of the resonator thereto. To hold the arrangement together, fasteners (not shown) extending through backplate 154, piezoelectric transducer element 150 and horn 152 may be provided. Alternatively, an adhesive such as an epoxy and conductive mesh layer may be used to bond the horn and piezoelectric transducer element together, without the requirement of a backing plate or bolts. Removing the backplate reduces the tolerances required in construction of the resonator, particularly allowing greater tolerance in the thickness of the piezoelectric element. The adhesive bonding of the horn to a piezoelectric transducer element is better described in U.S. patent application Ser. No. 07/620,520, "Energy Transmitting Horn Bonded to an Ultrasonic Transducer for Improved Uniformity at the Horn Tip", by R. Stokes.

The resonator may be arranged in association with a vacuum box arrangement 160 and vacuum supply 162 (vacuum source not shown) to provide engagement of resonator 100 to photoreceptor 10. FIG. 4 shows an assembly arranged for coupling contact with the backside of a photoreceptor in the machine shown in FIG. 1, which presents considerable spacing concerns. Accordingly, horn tip 158 extends through a generally air tight vacuum box 160, which is coupled to a vacuum source such as a diaphragm pump or blower (not shown) via outlet 162 formed in one or more locations along the length of upstream or downstream walls 164 and 166, respectively, of vacuum box 160. Walls 164 and 166 are approximately parallel to horn tip 158, extending to approximately a common plane with the contacting tip 159, and forming together an opening in vacuum box 160 adjacent to the photoreceptor belt 10, at which the contacting tip contacts the photoreceptor. The vacuum box is sealed at either end (inboard and outboard sides of the machine) thereof (not shown). A set of fasteners 170 is used in association with a bracket 172 connecting resonator 100 to the vacuum box 160 to resonator 100. The entry of horn tip 158 into vacuum box 160 is sealed with an elastomer sealing member 161, which also serves to isolate the vibration of horn tip 158 from wall 164 and 166 of vacuum box 160. When vacuum is applied to vacuum box 160, via outlet 162, belt 10 is drawn into contact with walls 164 and 166 and horn tip 159, so that horn tip 159 imparts the ultrasonic energy of the resonator to belt 10. Interestingly, walls 164 or 166 of vacuum box 160 also tend to damp vibration of the belt outside the area in which vibration is desired, so that the vibration does not disturb the dynamics of the sheet tacking or detacking process, or the integrity of the developed image. Other embodiments of vacuum coupling arrangements, and non-vacuum coupling arrangements, are described and shown in U.S. Pat. No. 5,010,369.

Application of high frequency acoustic or ultrasonic energy to belt 10 for transfer enhancement occurs within the area of application of transfer field, and preferably within the area under transfer corotron 40. Further description of the placement of the resonator with respect to transfer corotron 40 is provided at U.S. Pat. No. 5,016,055 to Pietrowski et al.

Figure 5A:
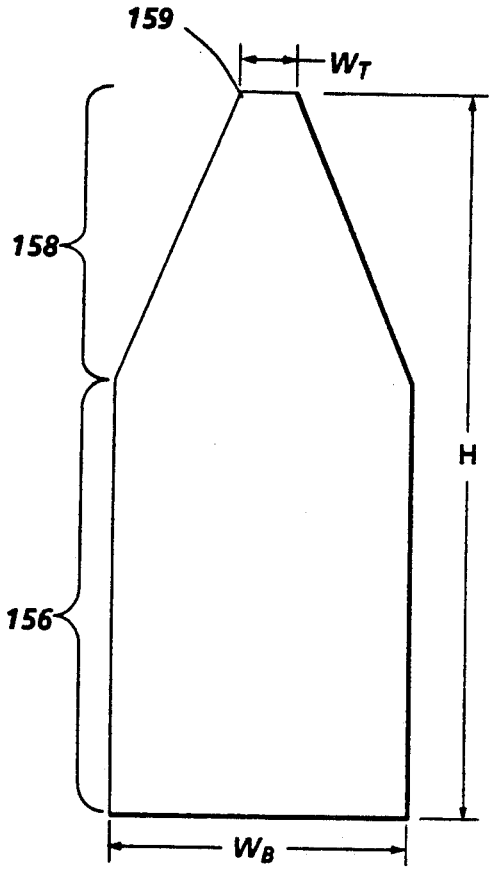
FIGS. 5A and 5B are cross sectional views of two types of horns suitable for use with the invention.
Figure 5B:
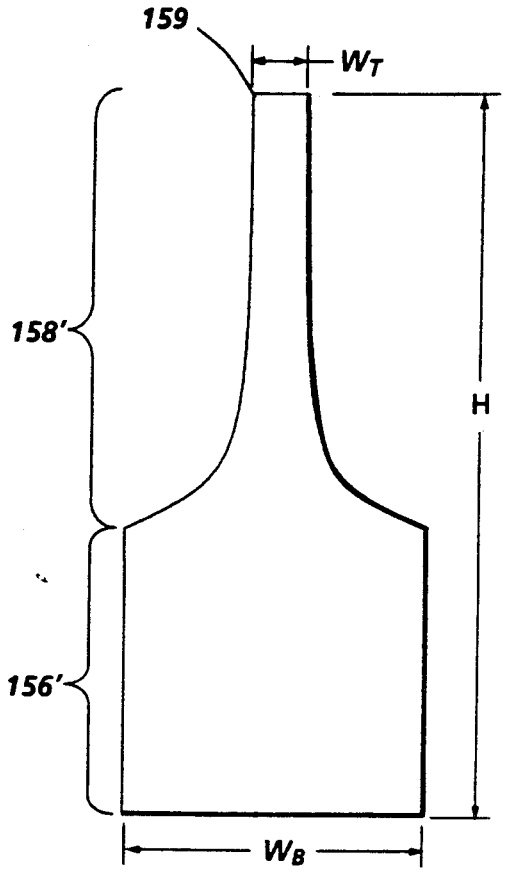

At least two shapes for the horn have been considered. With reference to FIG. 5A, in cross section, the horn may have a trapezoidal shape, with a generally rectangular base 156 and a generally triangular tip portion 158, with the base of the triangular tip portion having approximately the same size as the base. Alternatively, as shown in FIG. 5B, in cross section, the horn may have what is referred to as a stepped shape, with a generally rectangular base portion 156', and a stepped horn tip 158'. The trapezoidal horn appears to deliver a higher natural frequency of excitation, while the stepped horn produces a higher amplitude of vibration. The height H of the horn has an effect on the frequency and amplitude response, with a shorter tip to base length delivering higher frequency and a marginally greater amplitude of vibration. Desirably the height H of the horn will fall in the range of approximately 1 to 1.5 inches (2.54 to 3.81 cm), with greater or lesser lengths not excluded. The ratio of the base width $W_B$ to tip width $W_T$ also effects the amplitude and frequency of the response with a higher ratio producing a higher amplitude and a marginally greater frequency of vibration. The length L of the horn across belt 10 also effects the uniformity of vibration, with the longer horn producing a less uniform response. A desirable material for the horn is aluminum. Satisfactory piezoelectric materials, including lead zirconate titanate composites, sold under the trademark PZT by Vernitron, Inc. (Bedford, Ohio), and By Motorola, Inc. have high $D_{33}$ values. Displacement constants are typically in the range of 400–500 $m/_v \times 10-12$. There may be other sources of vibrational energy, which clearly support the present invention, including but not limited to magnetostriction and electrodynamic systems.

In considering the structure of the horn 152 across its length L, several concerns must be addressed. It is highly desirable for the horn to produce a uniform response along its length, or non-uniform transfer characteristics may result. It is also highly desirable to have a unitary structure, for manufacturing and application requirements.

In FIG. 6, horn segmentation is shown, as per U.S. Pat. No. 5,025,291 to Nowak et al., where horn 152 is fully segmented. In this embodiment, the horn is segmented though contacting tip 159 and tip portion 158, producing an open ended slot, but maintaining a continuous platform 156 and piezoelectric element 150. In such an arrangement, each segment acts more or less individually in its response. It is noted that the velocity response is greater across the segmented horn tip, than across the unsegmented horn tip, a desirable result. Such an arrangement, which produces an array of horn elements 1-N, provides the response along the horn tip, that tends toward uniformity across the contacting tip, as shown in curve A of FIG. 7B, but demonstrates a variable natural frequency of vibration across the tip of the horn. Curve A of FIG. 7B shows the response of a 24 element resonator varying from 350 mm/sec to 650 mm/sec, across the resonator.

In FIG. 7A, and in accordance with the invention, a section of a fully segmented horn 152 is shown, cut through contacting tip 159 of the horn and through tip portion 158, with continuous platform 156 and piezoelectric element 150. Into the narrow gap 200 defined by adjacent horn elements, an energy dissipating media is placed, comprising a viscoelastic material such as Dow Corning 732 RTV sealant. Undesirable cross process direction components of vibration can be attenuated by introducing such an energy absorbing media to the inter-element gaps. When the resonator vibrates in the axial direction, the horn elements will tend to move in phase with one another. Without relative motion between horn elements, energy dissipated into the energy absorbing media will be a minimum. However, when the resonator vibrates in the transverse direction, the horn segments will move out of phase with one another. With relative motion between horn elements, energy dissipation into the energy absorbing material will be at a maximum.

FIG. 7B shows a comparison of a transducer response without the energy absorbing media in the inter-element gaps (curve A), while also showing the response of the same transducer with a viscoelastic material such as Dow Corning 732 RTV sealant in the inter element gaps (curve B). While overall magnitude of transducer response is lower, the variation in response across the resonator is markedly more uniform. Curve B of FIG. 7B shows the response of a 24 element resonator with energy absorbing media in the inter-element gaps varying from about 200 mm/sec to 300 mm/sec, across the resonator.

In FIG. 8A, and in accordance with another aspect of the invention, a section of a fully segmented horn 152 is shown, cut through contacting tip 159 of the horn and through tip portion 158, with continuous platform 156 and piezoelectric element 150. On the downstream and upstream (process direction and reverse process direction) surfaces of tip portion 158, an energy dissipating media is placed, comprising in this case 3M® 5481 Teflon® Tape. FIG. 8B shows a cross section of the horn 152, which better shows the placement of the tape on the downstream and upstream surfaces of tip portion 158. Undesirable cross process direction components of vibration can be attenuated by introducing such an energy absorbing media bridging the inter-element gaps. In typical application the tape will extend uniformly across the length of the resonator. When the resonator vibrates in the axial direction, the horn elements will tend to move in phase with one another. Without relative motion between horn elements, energy dissipated into the energy absorbing media will be a minimum. However, when the resonator vibrates in the transverse direction, the horn segments will move out of phase with one another. With relative motion between horn elements, energy dissipation into the energy absorbing material will be at a maximum.

FIG. 8C shows a comparison of a transducer response without the energy absorbing media in the inter-element gaps (curve A), while also showing the response of the same resonator with an energy dissipating media (3M® 5481 Teflon® Tape) placed on the downstream and upstream surfaces of tip portion 158 (curve B). While overall magnitude of transducer response is lower, the variation in response across the resonator is markedly more uniform. Curve B of FIG. 7B shows the response of a 35 element resonator with energy absorbing media in the inter-element gaps varying from about 250 mm/sec to 350 mm/sec, across the resonator.

In yet another embodiment, not shown, the horn may be non-completely segmented, where the horn is segmented from the contacting tip to the platform portion, but leaving a continuous tip surface for engagement with the non-rigid member. In the inter-element gap, an energy absorbing media is inserted to dampen transverse mode vibration. Alternatively, and similar to the illustrated embodiments, an energy dissipating media (3M® 5481 Teflon® Tape) may be placed on the downstream and upstream surfaces of tip portion of the horn. In yet another alternative, energy dissipating media in tape form may be applied across the functional or contacting tip surface to similar effect.

With reference again to FIG. 1, it will no doubt be appreciated that the inventive resonator has equal application in the cleaning station of an electrophotographic device with little variation. Accordingly, as shown in FIG. 1, a resonator may be arranged in close relationship to the cleaning station F, for the mechanical release of toner from the surface prior to cleaning. Additionally, improvement in preclean treatment is believed to occur with application of vibratory energy simultaneously with preclean charge leveling. The invention finds equal application in this application.

As a means for improving uniformity of application of vibratory energy to a flexible member for the release of toner therefrom, the described resonator may find numerous uses in electrophotographic applications. One example of a use may be in causing release of toner from a toner bearing donor belt, arranged in development position with respect to a latent image. Enhanced development may be noted, with mechanical release of toner from the donor belt surface and electrostatic attraction of the toner to the image.

The invention has been described with reference to a preferred embodiment. Obviously modifications will occur to others upon reading and understanding the specification taken together with the drawings. This embodiment is but one example, and various alternatives, modifications, variations or improvements may be made by those skilled in the art from this teaching which are intended to be encompassed by the following claims.

We claim:

1. In an imaging device having a non-rigid imaging member with a charge retentive surface for supporting an image thereon, means for creating a latent image on the charge retentive surface, means for imagewise developing the latent image with toner, means for electrostatically transferring the developed toner image to a copy sheet, and a resonator for enhancing toner release from the charge retentive surface and producing relatively high frequency vibratory energy, and having a portion thereof adapted for contact across the non-rigid member, generally transverse to the direction of movement thereof, the resonator comprising:

a horn member for applying the high frequency vibratory energy to the non-rigid member, having a platform portion, a horn portion, and a contacting portion;

vibratory energy producing means coupled to said horn platform, for generating the high frequency vibratory energy;

means for coupling the horn member to the non-rigid member to apply axial mode toner releasing vibration thereto;

said horn member divided into a plurality of horn elements across said charge retentive surface of said imaging member, each horn element including a horn portion spaced from any adjacent horn elements, with adjacent horn elements forming a inter horn element gap thereinbetween, each horn vibrating, when driven by said vibratory energy producing means, in an axial mode releasing toner from the charge retentive surface, and a transverse mode, causing non-uniform response among said horn elements; and means for substantially damping said transverse mode vibration, while substantially allowing said axial mode vibration.

2. A device as defined in claim 1, wherein said damping means includes an energy dissipating material inserted into an inter horn element gap defined by adjacent horn elements.

3. A device as defined in claim 2, wherein said energy dissipating material inserted into an inter horn element gap is a visco-elastic material having the characteristics that when the horn element vibrates in the axial mode, energy dissipation is at a minimum, while when the horn element vibrates in the transverse mode, energy dissipation is at a maximum.

4. A device as defined in claim 1, wherein said damping means includes an energy dissipating material on a surface of said horn member, coupling the horn portions of each horn element to adjacent horn elements, bridging at least one inter horn element gap defined by adjacent horn elements.

5. A device as defined in claim 4, wherein said energy dissipating material on a surface of said horn member, is a visco-elastic material having the characteristics that when the horn element vibrates in the axial mode, energy dissipation is at a minimum, whiie when the horn element vibrates in the transverse mode, energy dissipation is at a maximum.

6. The device as defined in claim 1, wherein said vibratory energy producing means includes a substantially continuous piezoelectric element having a direction of vibration generally perpendicular to said charge retentive surface of said imaging member.

7. The device as defined in claim 1, wherein said vibratory energy producing means includes at least one piezoelectric element, corresponding to one or more of said horn elements, said at least one piezoelectric element having a direction of vibration generally perpendicular to said charge retentive surface of said imaging member.

8. The device as defined in claim 1, wherein said horn elements are characterized by including a horn portion and an imaging member contacting portion in substantially non-contacting relationship with a horn portion and a contacting portion of any adjacent horn elements.

9. A resonator adapted to enhance toner release from an imaging member, comprising:

a horn member for applying high frequency vibratory energy to an image bearing member, having a platform portion, a horn portion, and a contacting portion;

vibratory energy producing means coupled to said horn platform, for generating the high frequency vibratory energy;

means for coupling the horn member to a non-rigid member to apply axial mode toner releasing vibration thereto;

said horn member divided into a plurality of horn elements across said belt member, each horn element including a horn element horn portion and a horn element contacting portion in substantially non-contacting relationship with a horn element horn portion and a horn element contacting portion of any adjacent horn elements, each horn element vibrating, when driven by said vibratory energy producing means, in an axial mode toner releasing vibration, and a transverse mode causing non-uniform response among said horn elements; and means for substantially damping said transverse mode vibration, while substantially allowing said axial mode vibration.

10. A device as defined in claim 9, wherein said damping means includes an energy dissipating material inserted into an inter horn element gap defined by adjacent horn elements.

11. A device as defined in claim 10, wherein said energy dissipating material inserted into an inter horn element gap is a visco-elastic material having the characteristics that when the horn element vibrates in the axial mode, energy dissipation is at a minimum, while when the horn element vibrates in the transverse mode, energy dissipation is at a maximum.

12. A device as defined in claim 9, wherein said damping means includes an energy dissipating material on a surface of said horn member, coupling the horn portions of each horn element to adjacent horn elements, bridging at least one inter horn element gap defined by adjacent horn elements.

13. A device as defined in claim 12, wherein said energy dissipating material on the surface of said horn member, is a viscoelastic material having the characteristics that when the horn element vibrates in the axial mode, energy dissipation is at a minimum, while when the horn element vibrates in the transverse mode, energy dissipation is at a maximum.

14. The device as defined in claim 9, wherein said horn elements are characterized by including a horn portion and an imaging member contacting portion in substantially non-contacting relationship with a horn portion and a contacting portion of any adjacent horn elements.

15. In an imaging device having a non-rigid member with a charge retentive surface for supporting an image thereon, means for creating a latent image on the charge retentive surface, means for imagewise developing the latent image with toner, means for electrostatically transferring the developed toner image to a copy sheet, and a resonator for enhancing toner release from the charge retentive surface and producing relatively high frequency vibratory energy, and having a portion thereof adapted for contact across the non-rigid member, generally transverse to the direction of movement thereof, the resonator comprising:

a horn member for applying high frequency vibratory energy to the non-rigid member, having a platform portion, a horn portion, and a contacting portion;

vibratory energy producing means coupled to said horn platform portion, for generating the high frequency vibratory energy;

means for coupling the horn member to the non-rigid member to apply axial mode toner releasing vibration thereto;

said horn member divided into a plurality of horn elements across said belt member, each horn element including a horn element horn portion and a horn element contacting portion in substantially non-contacting relationship with a horn element horn portion and a horn element contacting portion of any adjacent horn elements, each horn element vibrating, when driven by said vibratory energy producing means, in an axial mode toner releasing vibration, and a transverse mode causing non-uniform response among said horn elements; and means for substantially damping said transverse mode vibration, while substantially allowing said axial mode vibration.

* * * * *